US005633474A

United States Patent [19]

Cardey, III

[11] Patent Number: 5,633,474

[45] Date of Patent: May 27, 1997

[54] SOUND EFFECTS CONTROL SYSTEM FOR MUSICAL INSTRUMENTS

[75] Inventor: Max L. Cardey, III, Riverside, Calif.

[73] Assignee: Sound Ethix Corp., Riverside, Calif.

[21] Appl. No.: 376,033

[22] Filed: Jan. 20, 1995

Related U.S. Application Data

[63] Continuation-in-part of Ser. No. 85,819, Jul. 2, 1993, abandoned, and Ser. No. 376,034, Jan. 20, 1995.

[51] Int. Cl.[6] ..... G10H 1/02; G10H 5/00

[52] U.S. Cl. ..... 84/663; 84/701; 84/737

[58] Field of Search ..... 84/662–665, 701–711, 84/723, 725, 730, 733, 734, 737–740

[56] References Cited

U.S. PATENT DOCUMENTS

| | | |
|---|---|---|
| Re. 31,019 | 8/1982 | Evangelista . |
| 3,443,018 | 5/1969 | Krebs . |
| 3,555,166 | 1/1971 | Gasser . |
| 4,281,573 | 8/1981 | Yarema . |
| 4,336,734 | 6/1982 | Polson . |
| 4,570,521 | 2/1986 | Fox . |
| 4,580,479 | 4/1986 | Bonanno . |
| 4,817,486 | 4/1989 | Saunders . |
| 4,867,028 | 9/1989 | Jones . |
| 4,905,560 | 3/1990 | Suzuki et al. . |
| 4,998,457 | 3/1991 | Suzuki et al. . |
| 5,007,324 | 4/1991 | DeMichele . |
| 5,300,730 | 4/1994 | Ekhaus . |

OTHER PUBLICATIONS

Product Literature for Vibrato Bridge: WVB VS80/VS90.

Product Literature for Roland GR–1 Guitar Synthesizer.

Product Literature for Alesis OEM Reverb Module SP–16.

*Primary Examiner*—Vit W. Miska

*Attorney, Agent, or Firm*—Knobbe, Martens, Olson & Bear, LLP

[57] ABSTRACT

A sound effects control system for musical instruments comprises a tactile controller and a control box. The controller generates, by means of manual or other bodily manipulation, a control signal which is communicated to the control box. The control box receives an output signal from the musical instrument and modifies it in accordance with the control signal received from the controller. The modified output signal is then communicated to a traditional amplifier which produces variations in the sound effects of the musical instrument, such as volume, tremolo, reverberation, etc. The tactile controller comprises a fluid-filled lumen which, in combination with the compressible material of the controller, is collapsible in response to manual manipulation in order to generate a static pressure control signal for varying the sound effects of the musical instrument. A wide variety of controller shapes, sizes, configurations, and locations on the musical instrument are available.

28 Claims, 4 Drawing Sheets

SOUND EFFECTS CONTROL SYSTEM FOR MUSICAL INSTRUMENTS

CROSS-REFERENCE TO RELATED APPLICATIONS

This application is a continuation-in-part of copending application Ser. No. 08/085,819, filed Jul. 2, 1993, entitled PRESSURE SENSITIVE AUDIO CONTROL APPARATUS AND GUITAR, and of application Ser. No. 08/376,034 filed on Jan. 20, 1995 (Our Ref: ROYALC.002CP2), entitled CONTROL SYSTEM FOR A MUSICAL INSTRUMENT, which is also incorporated herein by reference.

FIELD OF THE INVENTION

The present invention relates to a control system for controlling the sound and musical effects of musical instruments, and, more particularly, to a control system for controlling volume, tremolo, reverberation, and other musical effects of an electrical guitar or other musical instrument without requiring the musician to remove either hand from the keyboard, the accuracy of such control system being enhanced by a sensitive tactile controller.

BACKGROUND OF THE INVENTION

In modern music, a wide range of natural and synthesized musical sound effects is available. Moreover, there is a growing demand for new and variable sound effects which can be easily and quickly achieved from a single musical instrument. For example, musicians are also desirous of being able to adjust the volume, vibration, reverberation, and other sound effects possible with modern instruments. Although many such sound effects are available now, it is generally necessary to interrupt the musical piece in order to make any adjustment in such effects. In the case of an electrical guitar, for example, the playing of which requires two hands, either the fretting hand (i.e., the hand which forms the chords on the frets located on the neck of the instrument) or the strumming hand must be removed from the guitar in order to make adjustments in volume, etc. This interruption in play disrupts the continuity of the musical piece being performed.

In the case of the guitar, this problem has been addressed, in part, by the use of foot pedals which allow the guitarist to continue performing the musical piece without interruption while making adjustments in sound effects with the foot pedals. However, this arrangement has the disadvantage of requiring the musician to be tied to the particular location of the foot pedals, thus inhibiting a range of motion on the stage or other performing area. Other devices which have attempted to address this problem have not adequately met the needs of the musician by failing to provide an adequate range of sensitivity for adjustment. That is, such devices have not proven to be sufficiently sensitive in that they do not provide a fine range of adjustment in the volume and other sound effects which can be easily and accurately assessed by the artist.

Thus, there is a need for a device which allows a guitarist or other musician to dynamically control sound effects without interrupting play.

SUMMARY OF THE INVENTION

The sound effects control system of the present invention solves the problems associated with prior devices by providing a tactile controller with enhanced sensitivity performance, thus giving the musician accurate and sensitive adjustment capabilities without interrupting play. The controller may be used with an electrical guitar or other musical instrument, and can be adjustably applied to the instrument according to the style and needs of the artist. The controller can be easily accessed by the artist, thus avoiding the need to remove his or her hands from the instrument in order to adjust the sound effects. The controller is preferably manually manipulated, but can also be operated by other parts of the body, such as the feet, etc., compressed by bodily manipulation, or even blown into by the mouth. Thus, a wide range of possible uses in applications of the control system of the present invention are possible.

The tactile controller of the present invention preferably interfaces with a control box which receives a control signal generated by the controller. The control box uses this control signal to process, in any suitable manner well within the abilities of one of ordinary skill in the art, the signal generated by the electrical guitar or other musical instrument. The control box thus produces a resultant output signal which is relayed, either by direct wire or a wireless mechanism, to a typical amplifier containing a speaker for musical output. Thus, the control signal generated by the tactile controller of the present invention can be used to modify the typical sound of an electrical guitar or other musical instrument to produce a wide variety of sound effects, such a volume variations, reverberations, tremolo, and the like. These variations in sound effects, and the switching from one effect to another, can be achieved without musical interruption.

In one embodiment, the controller of the present invention comprises a compressible tube having an inner lumen filled with suitable fluid, such as air, liquid, gel, etc. The tube fluid, when its static pressure is increased or decreased, provides a control signal which is relayed to the control box for modifying the output of the instrument. Thus, the tactile controller of the present invention, in this compressible tube embodiment, provides a pneumatic or hydraulic control signal responsive to manipulation of the tube by the musician.

The tube is constructed from a material which can be readily compressed, either manually or by other mechanisms, resulting also in the collapsibility of the inner lumen and resultant increase in fluid static pressure within. Thus, for example, if the tube is compressed by a thumb or finger, the musician will have enhanced tactile sensitivity to a wide range of movement in the tube as, first, the tube wall is compressed and, secondly, the lumen within collapses in response to increased manual pressure. However, it should be noted that the relative compressibility of the tube wall and the variability of the static pressure of the fluid within can be independently adjusted to provide a wide range of tube tactile responses. For example, according to personal taste or required range of adjustment, the diameter of the tube and/or the level of inner static pressure can be increased or decreased. Thus, the present invention is not limited to any particular sequence or degree of tube compression or fluid pressure rise. It is, on the other hand, an important advantage of the present invention that these two elements cooperate to provide an improved feel or touch for the musician in order to achieve accurate, sensitive control.

Other advantages of the present invention relate to the shape and placement of the tactile controller. Simply put, the tactile controller, whether it be a tube or other configuration, can be of any length or location on the instrument which facilitates its use by the musician. Advantageously, the controller can be retrofitted to a guitar or other musical instrument by any suitable adhesive, which also allows the controller to be removed and placed in another location. The controller can be cut to length by the user, filled with the fluid provided, and applied to the instrument in any desired location. Thus, the control system of the present invention can be either incorporated into an instrument upon its manufacture or sold as a kit for retrofit to an existing instrument.

The tactile controller of the present invention can be any of a wide range of cross-sectional dimensions and configurations sufficient to allow the desired range of adjustment and tactile response. In one embodiment, a tube controller has a cross-section which is generally "d" shaped, the flat side of the d being used for mounting on the instrument and the rounded side providing enhanced contact and gripping capabilities. The radius of the rounded side of the controller can fall within a wide range of suitable lengths, it being noted that larger radii result in a gentle curve on which it is easier to maintain digital contact, while excessively short radii result in more circular shapes which may cause slippage.

As mounted on the instrument, the controller extends above the surface of the instrument so it is easy to see and access. Due to this raised mounting, the controller provides a full range of movement, including a feel for maximum pressure when the controller "bottoms out."

Taking one example of the present controller, a compressible tube having a collapsible inner lumen may be provided for volume control of an electrical guitar. A right-handed guitarist frets or forms chords with the fingers of the left hand (but not the thumb) and strums the strings of the guitar with the right hand. The thumb on the left hand is used to grip the neck of the guitar in order to provide an anchor for the fingers as they move in forming various chords. Thus, as merely one example of the applicability of the present invention, the control tube can be adhesively applied to the neck of the guitar along its length and near its upper surface so as to be accessible by the left thumb. Thus, no matter where the musician positions his or her left hand in order to form chords along the neck of the guitar, the control tube is accessible by the thumb for the application of manual pressure. As noted above, this pressure applied to the tube results in an increase in hydraulic or pneumatic pressure within the lumen of the tube, thus generating a control signal which is communicated by the tube itself to the control box. By suitable processing, the control box can use this control signal to increase or decrease the volume of musical output by the guitar. If no pressure is applied to the tube, the guitar can be placed in a bypass mode, which allows it to function without modification by the control system of the present invention. However, it is also possible that the control box can modify the output signal of the guitar so as to provide a "sustained" mode. In this mode, if a pressure is applied to the control tube, the volume may be increased or decreased and then sustained at that level even if pressure is removed from the tube. In order to once again adjust the volume, a pressure within a certain range less than the previous sustaining pressure would have to be applied to the tube in order to release the volume set. On the other hand, an applied pressure which is greater than the sustained pressure would continue to change the volume until the pressure is released, once again resulting in the final volume being sustained. Thus, the tube can be used in cooperation with the control box to achieve a wide variety of sound effects, not only in volume, but other effects as well.

Being less sensitive to tactile response than the fingers, the thumb requires a suitable range of motion in order to achieve accurate adjustment. Thus, as noted above, the raised mounting of the control tube, the compressibility of its outer wall and collapsibility of its inner lumen, all cooperate to provide a sensitive tactile controller.

In another embodiment, multiple controller tubes can be used to achieve, in combination, various sound effects. For example, in a guitar, one tube can be used to change from one effect to another, while a second or third tube can be used to vary the sound of that effect. Multiple control signals can be manifolded into the control box for appropriate processing and modification of the guitar output sound through the traditional amplifier.

Therefore, the present invention provides dynamic adjustments in sound effects without interrupting play, and also provides greater creativity and freedom of expression for the musician.

DETAILED DESCRIPTION OF THE PREFERRED EMBODIMENTS

Figure 1:
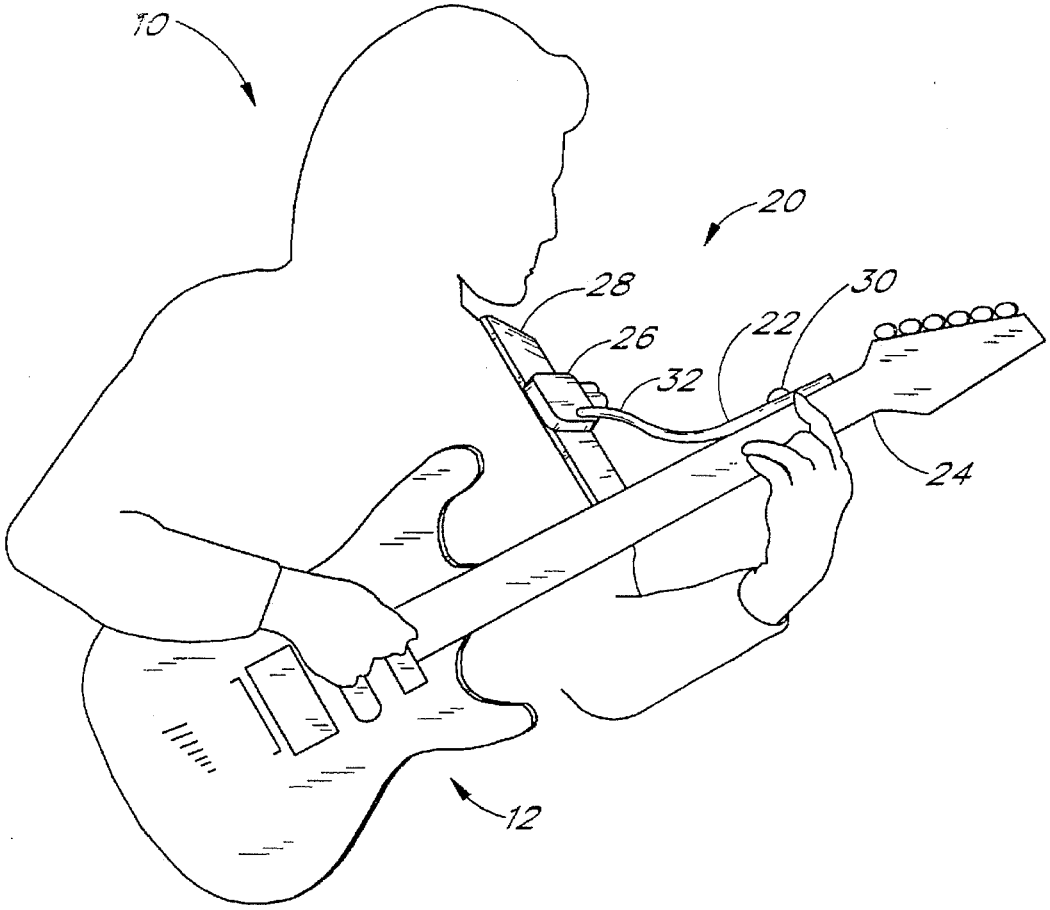
FIG. 1 is a schematic view of a musician playing a guitar on which is mounted the sound effects control system of the present invention including a tactile controller mounted along the neck of the guitar and a control box mounted on the shoulder strap.

Referring to FIG. 1, there is shown a musician 10 playing a guitar 12 on which is mounted the sound effects control system 20 of the present invention. This system 20 comprises a controller 22 shown mounted along a portion of the neck 24 of the guitar 12, the controller 22 being in communication with a control box 26 shown mounted on the shoulder strap 28. Although the present system 20 is shown mounted in a particular location with respect to the guitar 12 in FIG. 1, it should be noted that both the controller 22 and the control box 26 can be suitably mounted in a wide variety of locations on a guitar and can also be either incorporated into the guitar or retrofit to existing guitars. Moreover, the present system 20 can be utilized in connection with a wide variety of musical instruments, and its principles are not limited to controlling the sound effects of guitars. In addition, the controller 22 and the control box 26 can be in communication with one another in a wide variety of arrangements and configurations.

FIG. 1 illustrates the controller 22 being mounted along the upper portion of the neck 24 of the guitar 12 and being accessed by the thumb 30 of the guitarist 10. Thus, in response to this manipulation of the controller 22, a control signal is communicated by the controller 22 to the control box 26. It will be noted that the controller 22 is mounted in a raised position on the neck 24 of the guitar 12 so as to be easily accessible by the guitarist 10, thus avoiding the interruption of play. The controller 22 is preferably collapsible to provide a range of movement for tactile adjustment by the guitarist 10, each change in movement producing a variation in the control signal which ultimately results in a variation of the output sound effect of the guitar. Although the controller 22 of the present invention is shown and described as a tactile controller, it is not limited to a manually manipulable controller, but can be manipulated by other forms of bodily or non-bodily contact.

Figure 1A:
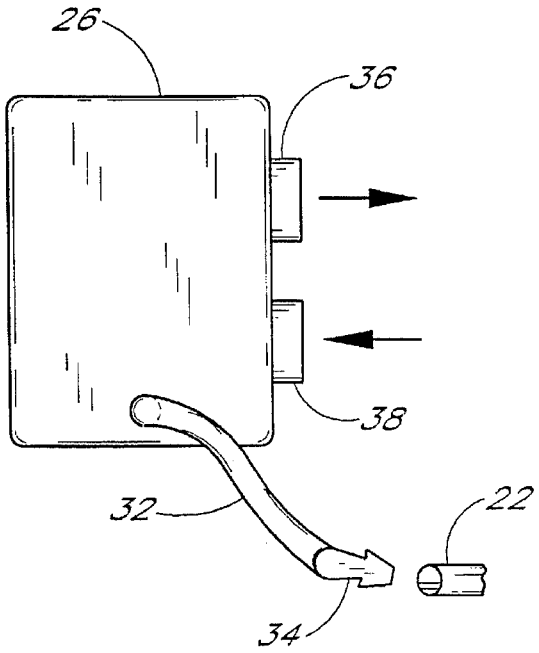
FIG. 1*a* is a close-up plan view of the control box including a control signal extension and a coupler for receiving the tactile controller.

FIG. 1*a* illustrates in greater detail the control box 26 of the present system. The control box 26 receives the control signal from the controller 22 through a control signal extension 32 which extends distally away from the control box 26. A coupler 34 is provided at the distal end of the extension 32 to facilitate connection with the controller 22, thus avoiding the necessity of connecting the controller 22 directly to the control box 26 and avoiding any possible damage to elements contained therein. The control box 26 further comprises a guitar signal input 36 which receives the normal electrical signal generated by the strumming of the strings on the electrical guitar 12. This signal is modified and otherwise processed by the control signal supplied to the control box 26 by the controller 22, resulting in an output signal 38. This output signal 38 is communicated, either by direct wire or wireless techniques, to a traditional amplifier (not shown) for generation of the sound through the incorporated speaker. The control box 26 can be programmed, in accordance with well-known techniques within the ability of one of ordinary skill, to provide a variety of different sound effects and variation in such sound effects in response to the control signal from the controller 22.

Figure 2:
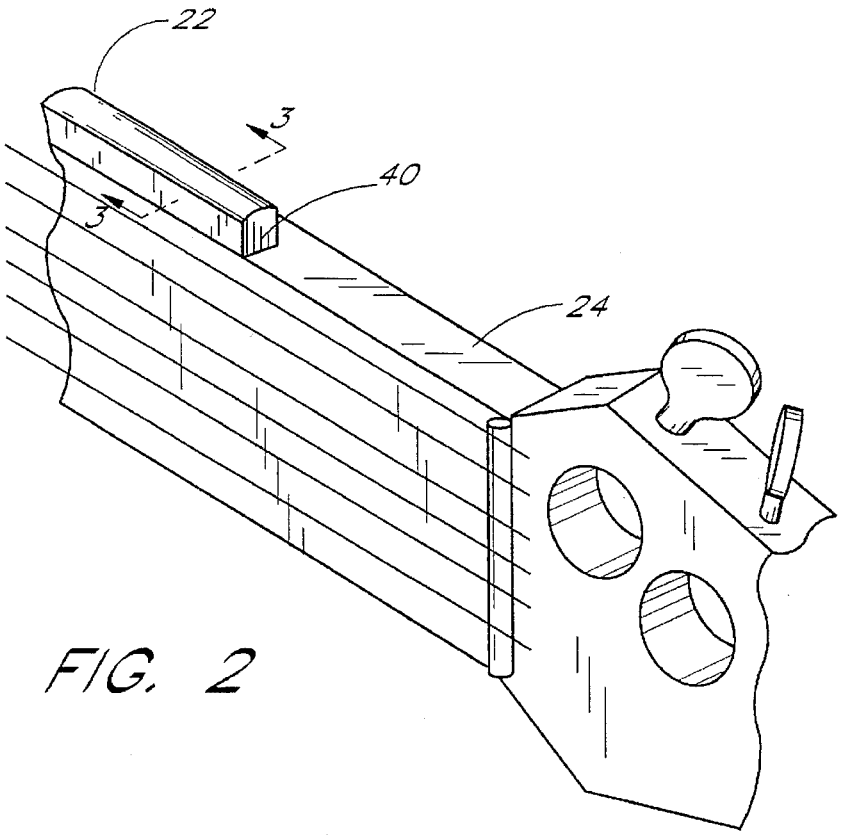
FIG. 2 is a close-up perspective view of the neck of the guitar on which is shown mounted a section of the tactile controller.
Figure 2A:
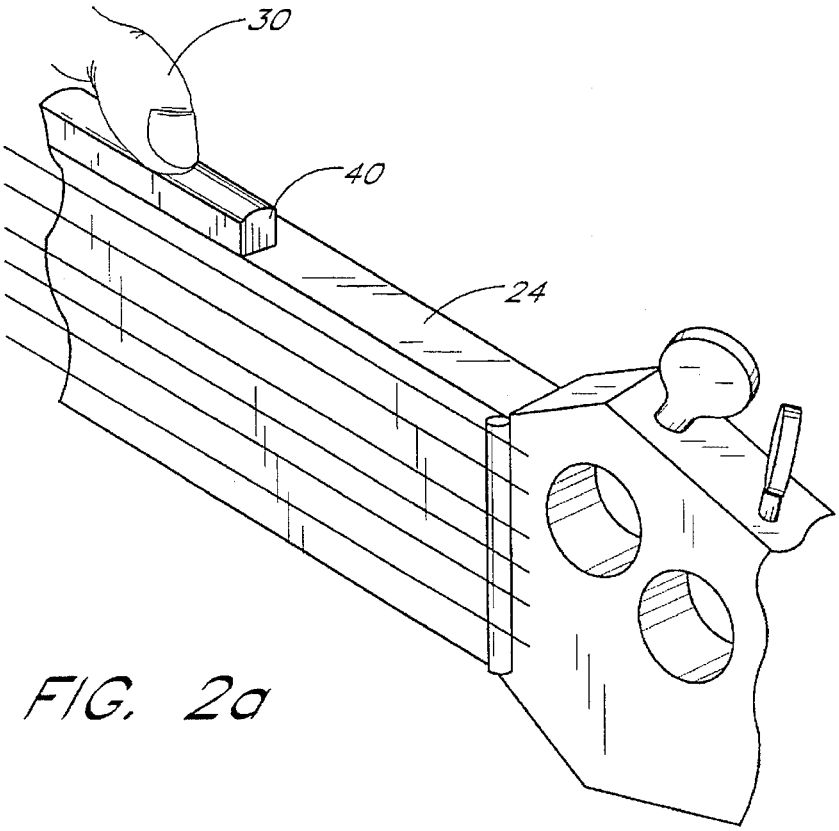
FIG. 2*a* is a close-up perspective view similar to FIG. 2 illustrating the placement of the musician's thumb on the tactile controller.

FIG. 2 illustrates the tactile controller 22 of the present invention shown mounted along the upper edge of the guitar neck 24. The controller 22 has a closed end 40, so that static pressure will increase upon manipulation. As noted above, the controller 22 can be of any suitable length and can be placed in any suitable position on the guitar 12 or its neck 24. Although the controller 22 is shown to be linearly disposed along the neck 24 in FIGS. 1 and 2, it can also be placed in an S-shape arrangement to make it more readily accessible by the guitarist 10, depending upon the type of chords that are being played. It is important to note that, regardless of the location or configuration, the tactile controller 22 is mounted on the surface of the guitar 12 so as to be in a raised, accessible position. Thus, as shown in FIG. 2*a*, the controller 22 can be accessed and compressed by the thumb 30 in order to produce the appropriate control signal. As the thumb 30 more or less compresses the controller 22, the control signal is varied accordingly in order to produce a different sound effect. It should be noted that, depending upon the programming of the control box 26, increased manual pressure by the thumb 30 on the controller 22 can result in either increased or decreased volume or sound effect variation. Thus, the sound effects can be either directly or inversely related to the compression of the tactile controller 22.

It will also be noted from FIG. 2*a* that the controller 22 is slightly rounded on its upper surface 42. As explained in greater detail in connection with FIG. 3, this configuration increases the surface area contact with the thumb 30, thereby maintaining better contact and avoiding slippage. However, it should be noted that a wide variety of controller cross-sectional configurations are within the principles of the present invention.

Figure 3:
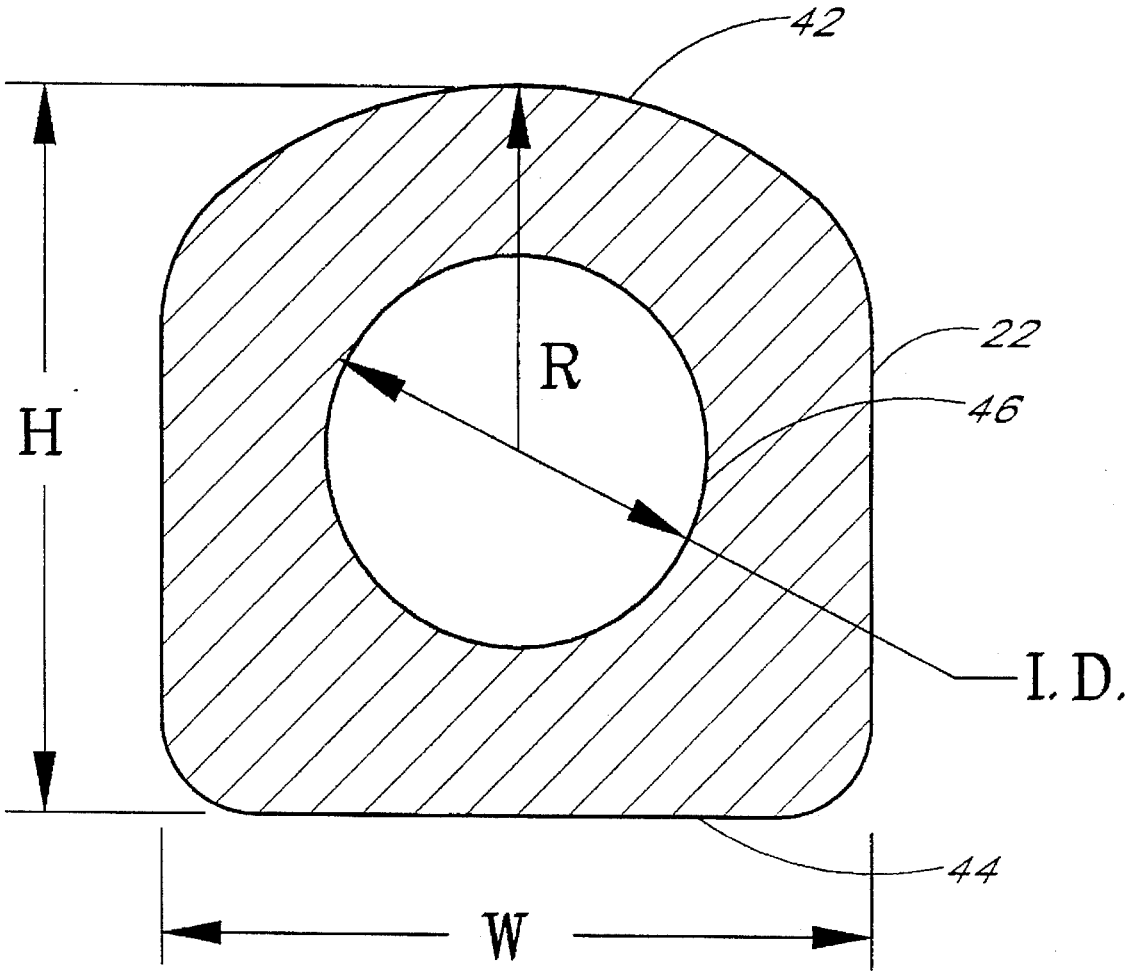
FIG. 3 is a cross-sectional view of the tactile controller of one embodiment of the present invention.

Referring to FIG. 3 there is shown a cross-sectional view of one embodiment of the tactile controller 22 of the present invention. In this embodiment, the base 44 of the controller 22 has squared corners while the top surface 42 is rounded, as described above in connection with FIGS. 2 and 2*a*. The overall height (H) of the controller is approximately ¼ inch, as is the width (W). The lumen 46 of the controller 22 has an inner diameter (ID) of approximately ⅛ inch. The gentle rounded upper surface 42 of the controller 22, as described above, provides good surface area contact for manual manipulation, without corners or circular surfaces which may result in slippage. Thus, a preferred radius (R) for the rounded upper surface 42 is about 0.20 to 0.25 inches. The tactile controller 22 of the present invention, in one embodiment, may take the form of a tube-like device having a concentric lumen.

The tactile controller 22 of the present invention is not limited to a fluid-filled tube, but can comprise a collapsible device which is externally mounted on the instrument and which is constructed from a material or combination of materials which results in a degree of collapsibility which is sufficient to provide enhanced tactile control. In the embodiment of FIG. 3, the controller can be constructed from a wide variety of suitable materials which are relatively soft and compressible, such as neoprene. Thus, one such suitable material is a closed cell neoprene sponge which is externally coated with a urethane coating. This coating prevents the escape of air from the controller 22 in the embodiment where the control signal comprises pneumatic pressure generated by manipulation of the tactile control tube. Moreover, it is also possible to coat the interior surface of the lumen 46 of the tube with urethane in order to prevent the bleeding of air into the cells which make up the tube. In addition, the external urethane coating provides a slightly tacky surface which improves the manual grip available to the guitarist 10. It should also be noted that other cross-sectional dimensions for the controller 22 are possible. It has been found that a controller which is approximately 15% smaller in cross-sectional size than the controller 22 shown in FIG. 3 also provides suitable tactile response.

Figure 4:
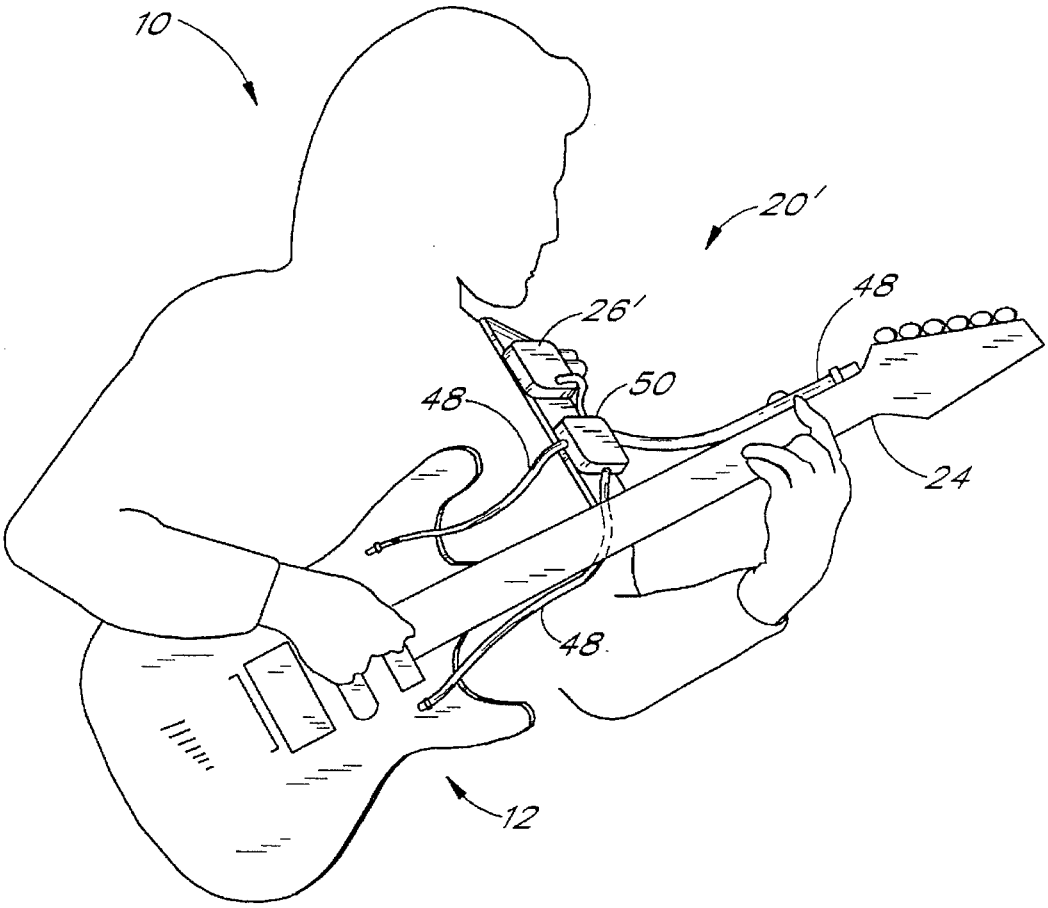
FIG. 4 is a schematic view similar to FIG. 1, illustrating a multiple controller configuration.

FIG. 4 illustrates another embodiment of the present invention which utilizes multiple tactile controllers 48 used in combination with a control signal manifold box 50. Thus, one controller 48 can be used to vary the effect (such as volume, tremolo or reverberation, etc.), while the other controller 48 can be used to modify the output of that particular effect (such as increase or decrease in volume, increase in speed or depth of tremolo, etc.). Thus, the principles of the present invention are not limited to any particular number, size, or configuration of control devices.

Figure 5:
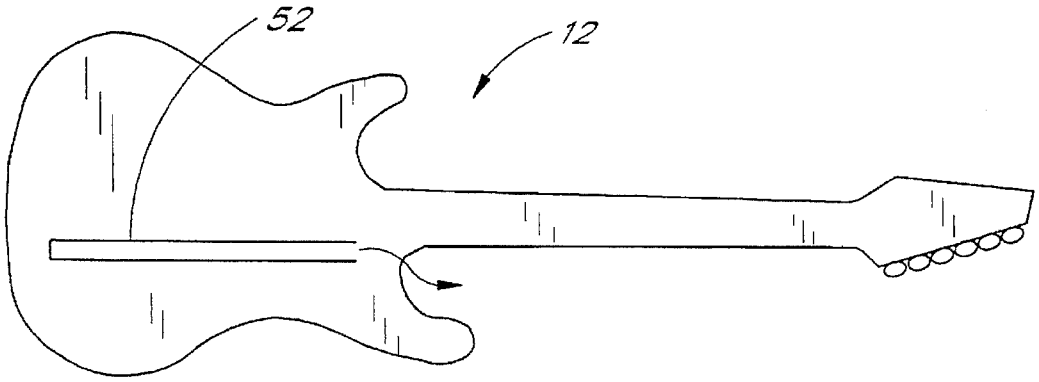
FIG. 5 is a schematic view of the back of the guitar illustrating an alternate placement for the controller of the present invention.

FIG. 5 illustrates the back of the guitar 12 on which a tactile controller 52 has been positioned by means of suitable adhesive. In this embodiment, the controller 52 can be manipulated by the guitarist 10 due to the compression of the controller 52 between the guitar 12 itself and the body of the guitarist 10. Thus, there are other forms of manipulation of the controller, besides manual manipulation.

Although there has been described herein a sound effects control system for musical instrument in accordance with the present invention, it will be appreciated that the invention is not limited to the particular embodiments shown in the drawing of described in this specification. Accordingly, any and all modifications, variations, or equivalent arrangements which may occur to those of ordinary skill in the art should be considered to be within the scope of the present invention as defined by the appended claims.

What is claimed is:

1. A sound effects control system adapted to be used in connection with a musical instrument, said instrument generating an output signal for transformation into a musical sound, the system comprising:

a tactile controller mounted externally on said instrument so as to be in a raised positioned on the surface of said instrument, said controller being constructed from a compressible material which can be readily compressed by a musician through a predefined range of physical movement, said controller further comprising a fluid-filled lumen which, upon the compression of said controller, collapses in response to said pressure to define a fluid static pressure; and a control box in communication with said controller so as to receive said static pressure as a control signal, said control box receiving said output signal from said instrument and modifying it in accordance with said control signal to generate a modified output signal for varying the sound effects of said musical instrument.

2. The system of claim 1, wherein said tactile controller comprises a tube that is positioned on a surface of said musical instrument and wherein said musician depresses said tube towards said surface to induce said control box to generate a modified output signal.

3. The system of claim 2, wherein said lumen comprises a chamber having a first and a second end, wherein said first end of said chamber is closed and said second end of said chamber is in fluid communication with said control box.

4. The system of claim 3, wherein said tactile controller has a top and a bottom surface and wherein said bottom surface is adhered to said surface of said musical instrument and wherein said upper surface of said tactile controller is rounded.

5. The system of claim 4, wherein said tactile controller has a cross-sectional width of approximately 0.25 inches, a height, from said bottom surface to an uppermost point on said upper surface, of approximately 0.25 inches and wherein said lumen is a concentric circular passageway having 0.125 inches diameter.

6. The system of claim 1, wherein said lumen of said tactile controller is air filled and said control box receives a pneumatic signal as said control signal.

7. The system of claim 1, wherein said tactile controller is constructed from a length of closed cell neoprene sponge which is externally coated with a urethane coating.

8. The system of claim 1, wherein said musical instrument comprises an electric guitar and wherein said tactile controller is positioned on said guitar in a position where said musician can depress said tactile member while simultaneously playing the guitar without removing his or her hands from the strings of guitar.

9. The system of claim 7, wherein said tactile controller is positioned on the neck of the guitar on a surface wherein said musician can depress said tactile controller with his or her thumb while simultaneously depressing the strings of the guitar on the frets on the neck of said guitar.

10. A system for varying the sound signals output from a musical instrument comprising:

at least one tactile controller constructed from a compressible material and defining a lumen, wherein said at least one tactile controller is compressible through a pre-determined range of physical motion which results in a corresponding change of pressure within said lumen and wherein said at least one tactile controller is configured to be mounted externally in a raised position on a surface of said musical instrument in a location wherein said musician can depress said at least one tactile controller towards said surface to thereby produce a control signal that corresponds to the change of pressure within said lumen of said at least one tactile controller, while simultaneously playing said musical instrument; and a control box which receives said control signal and also receives an output signal from said musical instrument and, in response to receiving said control signal, modifies said output signal to generate a modified output signal for varying the sound effects of said musical instrument.

11. The system of claim 10, wherein said at least one tactile controller comprises a plurality of tactile controllers wherein each of said plurality of tactile controllers are configured to be mounted externally in a raised position on a plurality of surfaces of said musical instrument in locations wherein said musician can depress each of said plurality of tactile controllers towards said surface to thereby produce said control signal, while simultaneously playing said musical instrument.

12. The system of claim 11 wherein said control box receives said control signal from each of said plurality of tactile controllers and uses said control signal to modify said output signal to produce said modified output signal.

13. The system of claim 9, wherein said one or more tactile controllers are comprised of one or more lengths of tubing having central lumen filled with fluid wherein depression of said one or more tactile members results in a proportionate change in pressure within said lumen and wherein said proportionate change in pressure comprises said control signal.

14. The system of claim 13, wherein said one or more lengths of tubing comprises a plurality of lengths of tubing and said system further comprises a manifold which receives said control signal from each of said plurality of lengths of tubing and said manifold provides said control signal to said control box.

15. The system of claim 14, wherein said musical instrument comprises an electric guitar and wherein a first length of tubing of said plurality of lengths of tubing is mounted on a top surface of a neck of the guitar wherein the musician can depress said first length of tubing towards said top surface with his or her thumb of a first hand while simultaneously using his or her fingers of said first hand to depress the strings on the frets of the guitar.

16. The system of claim 15, wherein said first length of tubing is sized to permit simultaneous depression of said first length of tubing and depression of said strings on the frets of the guitar over the entire length of the fret portion of the neck of the guitar.

17. The system of claim 14, wherein a second length of tubing of said plurality of tubing is positioned on a surface of said guitar adjacent the location of said guitar where said musician strums said guitar so that said musician can depress said second length of tubing towards said surface with one digit while using the other digits of his or her hand to strum the guitar.

18. The system of claim 14, wherein a third length of tubing of said plurality of lengths of tubing is positioned on a back side surface of said guitar so that said musician can depress said third length of tubing by compressing said third length of tubing between said back side of said guitar and said musician's body.

19. A system for varying the sound signals output from a musical instrument comprising:

means for producing a control signal by depression of said means from a raised position above a first surface towards said first surface of said musical instrument wherein said means includes a lumen and depression of said means towards said first surface results in a change of pressure within said lumen; and means for modifying an output signal of said musical instrument in response to receiving said control signal.

20. The system of claim 19, wherein said means for producing a control signal comprises a tactile controller mounted externally in a raised position on a surface of said musical instrument.

21. The system of claim 20, wherein said tactile controller comprises a length of tubing having a central lumen wherein depression of said length of tubing towards said surface of said musical instrument results in a change of pressure within said central lumen and wherein said control signal is reflective of said change in pressure.

22. The system of claim 21, wherein said musical instrument comprises an electric guitar and said length of tubing is positioned on the neck of said guitar.

23. The system of claim 19, wherein said means for modifying an output signal comprises a control box which receives an output signal from said musical instrument and said control signal.

24. A method of varying the sound signals output from a musical instrument comprising the steps of:

positioning a tactile member having a lumen on a first surface of a musical instrument so that an upper surface of said tactile member is raised above said first surface;

depressing said tactile member towards said first surface so that a change of pressure within said lumen occurs and so that said tactile member produces a control signal that corresponds to said change of pressure within said lumen; and modifying an output signal produced by said musical instrument based upon said control signal.

25. The method of claim 24, wherein the positioning step comprises positioning a length of tubing having a fluid filled lumen on a musical instrument in a position where a musician can depress said length of tubing, and thereby affect the pressure of said fluid within said lumen, while simultaneously playing said musical instrument.

26. The method of claim 25, wherein the positioning step comprises positioning said length of tubing on a neck of an electric guitar.

27. The method of claim 26, further comprising the step of determining the change in pressure within the lumen as a result of the depression step.

28. The method of claim 27, wherein the modifying step comprises increasing the volume of the sound signal produced by the musical instrument proportionately to the change in pressure within the lumen as a result of the depression step.

* * * * *